US011130660B2

(12) United States Patent
Prentice et al.

(10) Patent No.: US 11,130,660 B2
(45) Date of Patent: Sep. 28, 2021

(54) LIFT TRUCK ATTACHMENTS

(71) Applicant: Cascade Corporation, Fairview, OR (US)

(72) Inventors: Glenn Steven Prentice, Milwaukie, OR (US); Tamara S. Dib, Portland, OR (US)

(73) Assignee: Cascade Corporation, Fairview, OR (US)

( * ) Notice: Subject to any disclaimer, the term of this patent is extended or adjusted under 35 U.S.C. 154(b) by 0 days.

(21) Appl. No.: 16/737,664

(22) Filed: Jan. 8, 2020

(65) Prior Publication Data

US 2021/0206608 A1 Jul. 8, 2021

(51) Int. Cl.

| | |
|---|---|
| ***B66F 9/14*** | (2006.01) |
| ***B66F 9/22*** | (2006.01) |
| ***B66F 9/075*** | (2006.01) |

(52) U.S. Cl.

CPC ..... *B66F 9/148* (2013.01); *B66F 9/07504* (2013.01); *B66F 9/143* (2013.01); *B66F 9/22* (2013.01)

(58) Field of Classification Search

CPC .. B66F 9/144; B66F 9/14; B66F 9/148; B66F 9/143

See application file for complete search history.

(56) References Cited

U.S. PATENT DOCUMENTS

| | | | | |
|---|---|---|---|---|
| 4,323,132 | A | 4/1982 | Bradley | |
| 4,560,016 | A | 12/1985 | Ibanez et al. | |
| 5,147,171 | A | 9/1992 | Murray et al. | |
| 5,635,680 | A | 6/1997 | Dojan | |
| 5,707,201 | A * | 1/1998 | Hamlik | B66F 9/148 414/668 |

(Continued)

FOREIGN PATENT DOCUMENTS

| | | | |
|---|---|---|---|
| CN | 207276135 | U | 4/2018 |
| EP | 0489486 | A1 | 6/1992 |

OTHER PUBLICATIONS

United States Patent and Trademark Office; International Search Report and Written Opinion dated Mar. 26, 2021 for Int'l. App. No. PCT/US2021/012761; 14 pages.

*Primary Examiner* — Mark C Hageman

(74) *Attorney, Agent, or Firm* — Chernoff, Vilhauer, McClung & Stenzel, LLP

(57) ABSTRACT

Lift truck attachment assemblies are shown and disclosed. In some embodiments, the lift truck attachment assembly includes a carriage assembly having a carriage and a linear actuator attached to the carriage. The carriage is mountable to a lift truck, and the linear actuator includes a body and longitudinally opposed piston rods slidably received in the body, each of the piston rods having an end. The attachment assembly additionally includes a frame assembly slidably connected to the carriage. The frame assembly includes upper and lower transverse frame members and end vertical frame members connecting the upper and lower transverse frame members in a spaced relationship to define a frame central cavity therebetween. The linear actuator is disposed within the frame central cavity such that the ends of the piston rods contact the end vertical frame members allowing the linear actuator to slide the frame assembly laterally relative to the carriage assembly.

6 Claims, 11 Drawing Sheets

(56) References Cited

U.S. PATENT DOCUMENTS

| | | | | |
|---|---|---|---|---|
| 5,807,060 | A * | 9/1998 | Hamlik | B66F 9/148 414/668 |
| 5,837,946 | A | 11/1998 | Johnson et al. | |
| 6,037,550 | A | 3/2000 | Bradley | |
| 6,279,686 | B1 * | 8/2001 | Kaup | B66F 9/143 187/227 |
| 6,390,763 | B1 | 5/2002 | Prentice | |
| 6,672,823 | B2 | 1/2004 | Henning | |
| 7,008,167 | B2 * | 3/2006 | Henning | B66F 9/143 414/667 |
| 7,454,972 | B2 | 11/2008 | Heyman et al. | |
| 7,909,563 | B2 | 3/2011 | Prentice | |
| 7,992,686 | B2 | 8/2011 | McCabe | |
| 8,716,609 | B2 | 5/2014 | Pangrazio et al. | |
| 9,073,738 | B2 | 7/2015 | Johnson | |
| 9,187,303 | B2 | 11/2015 | Pangrazio et al. | |
| 9,562,804 | B2 | 2/2017 | Santi | |
| 9,663,337 | B2 * | 5/2017 | Kuck | B66F 9/12 |
| 10,048,110 | B2 | 8/2018 | Demozzi et al. | |
| 10,087,060 | B2 * | 10/2018 | Hamlik | B66F 9/148 |
| 10,640,349 | B2 * | 5/2020 | Prentice | B66F 9/22 |
| 2003/0156935 | A1 * | 8/2003 | Mondani | B66F 9/143 414/667 |
| 2006/0115349 | A1 | 6/2006 | Prentice | |
| 2007/0079558 | A1 | 4/2007 | Foroni | |
| 2008/0152471 | A1 * | 6/2008 | Polvilampi | B66F 9/148 414/671 |
| 2012/0273306 | A1 | 11/2012 | Pangrazio et al. | |
| 2015/0093216 | A1 | 4/2015 | Pangrazio et al. | |
| 2015/0233755 | A1 | 8/2015 | Pangrazio | |
| 2018/0354761 | A1 * | 12/2018 | Addicott | B66F 9/148 |
| 2019/0241417 | A1 | 8/2019 | Prentice et al. | |

* cited by examiner

LIFT TRUCK ATTACHMENTS

CROSS REFERENCE TO RELATED APPLICATIONS

None

BACKGROUND

The subject matter of this application relates to lift truck attachments, such as for load lifting, load shifting, and/or load weighing.

Attachments to lift trucks are typically added to a standard carriage that carries the lifting forks to provide added range of motion and/or other functionalities. However, the attachments offset the position of the lifting forks an additional distance from the front axle of the lift truck, which reduces the lifting capacity of the lift truck. What is desired, therefore, is an integrated lift truck attachment that allows the nesting of components to provide the desired added range of motion and other functionalities for the lifting forks while reducing the distance of the lifting forks from the front axle of the lift truck and increasing the capacity of the lift truck.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
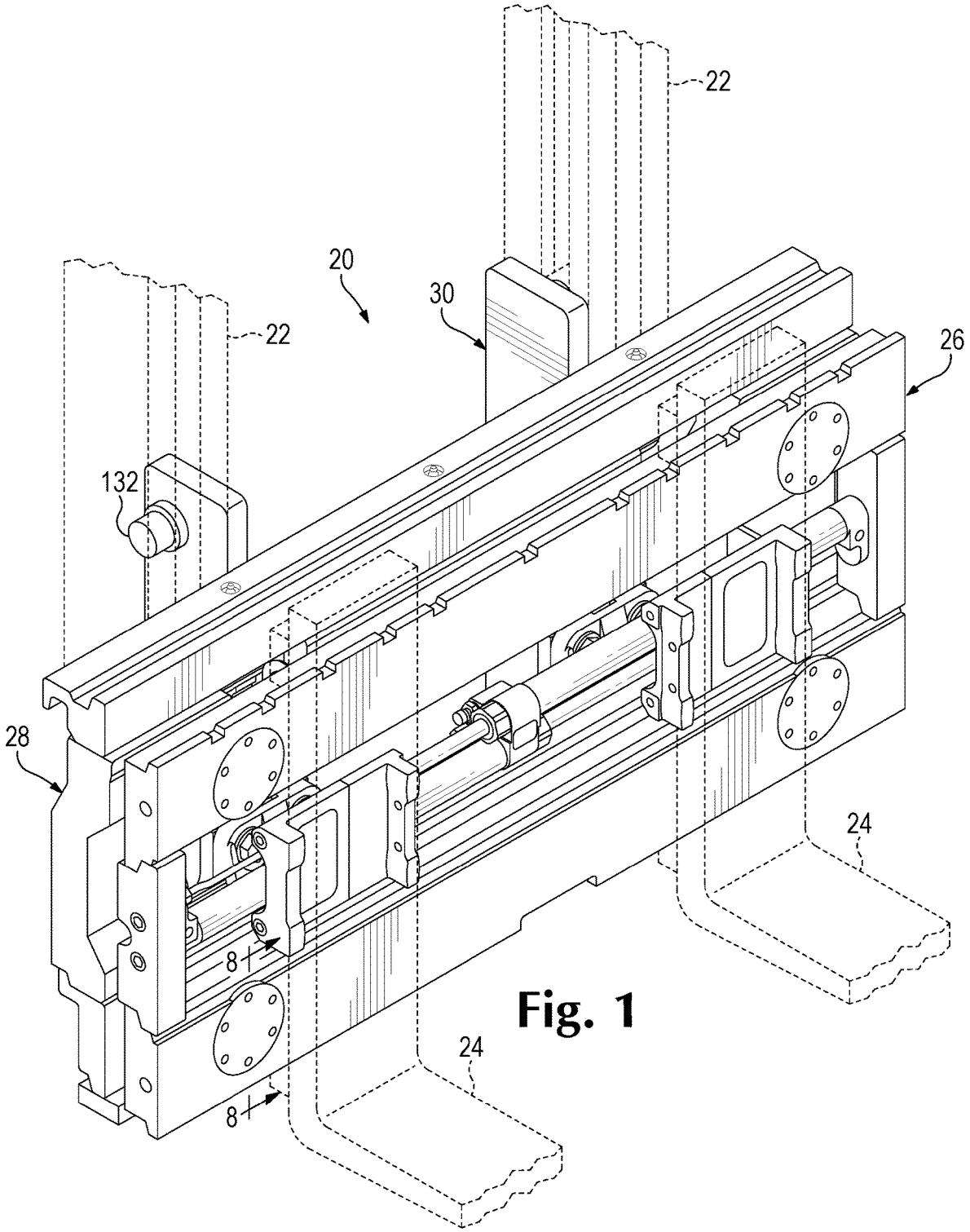
FIG. 1 is a perspective view of an illustrative example of an integrated lift truck attachment assembly shown mounted to a lift truck and with lift forks mounted to a fork positioner of the lift truck attachment assembly.
Figure 2:
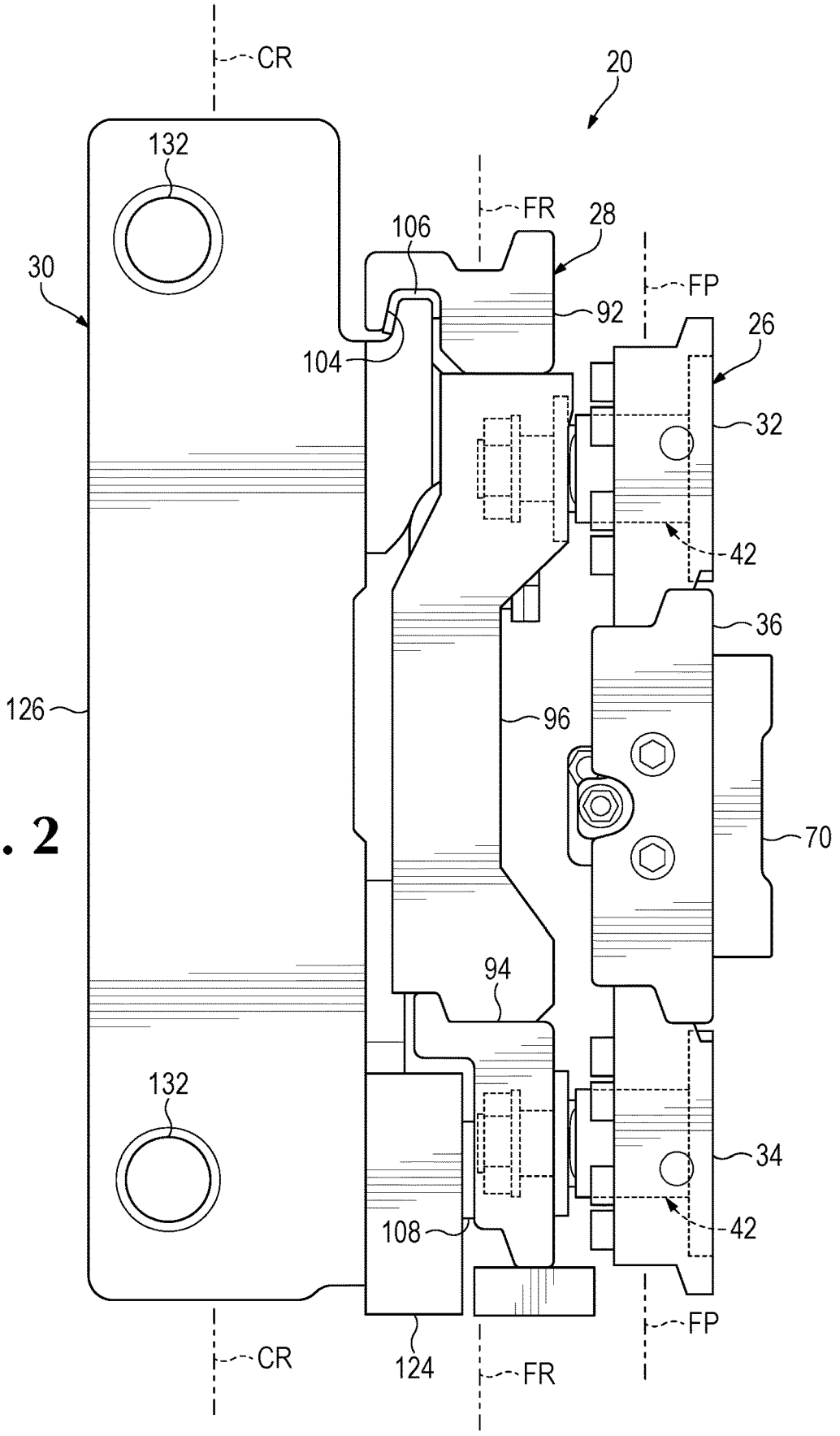
FIG. 2 is a side view of the integrated lift truck attachment assembly of FIG. 1.

Referring to FIGS. 1-2, an illustrative example of an integrated lift truck attachment assembly 20 is shown. Attachment assembly 20 is shown received in mast channels 22 of a lift truck and supporting lift forks 24. Lift truck attachment assembly 20 includes a faceplate assembly 26, a frame assembly 28, and a carriage assembly 30. As shown in FIG. 2, at least a substantial portion of each of the faceplate, frame, and carriage assemblies are within separate faceplate FP, frame FR, and carriage CR planes, respectively, which are spaced and parallel to each other.

Figure 3:
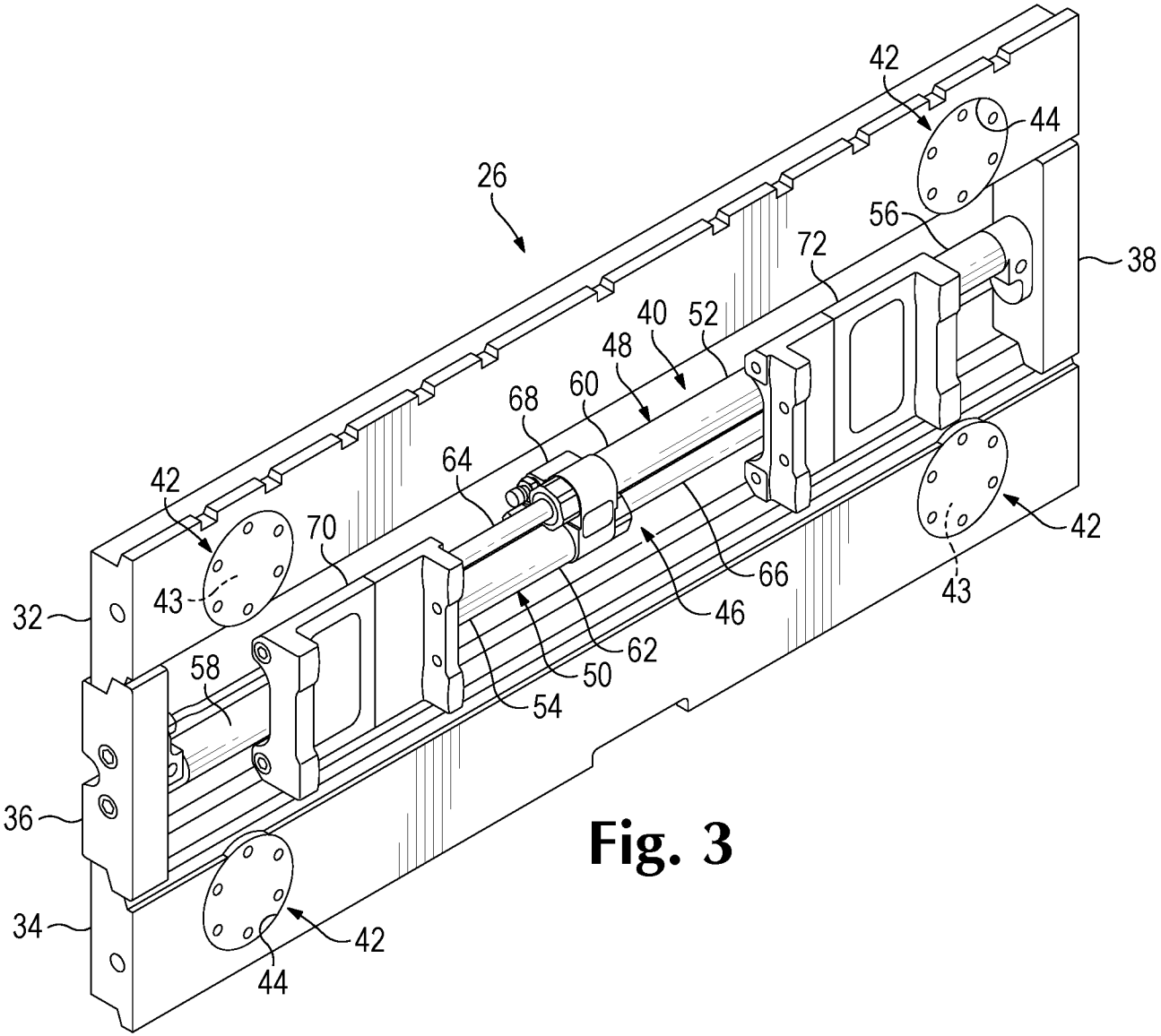
FIG. 3 is a front perspective view of a faceplate assembly of the integrated lift truck attachment assembly of FIG. 1.
Figure 4:
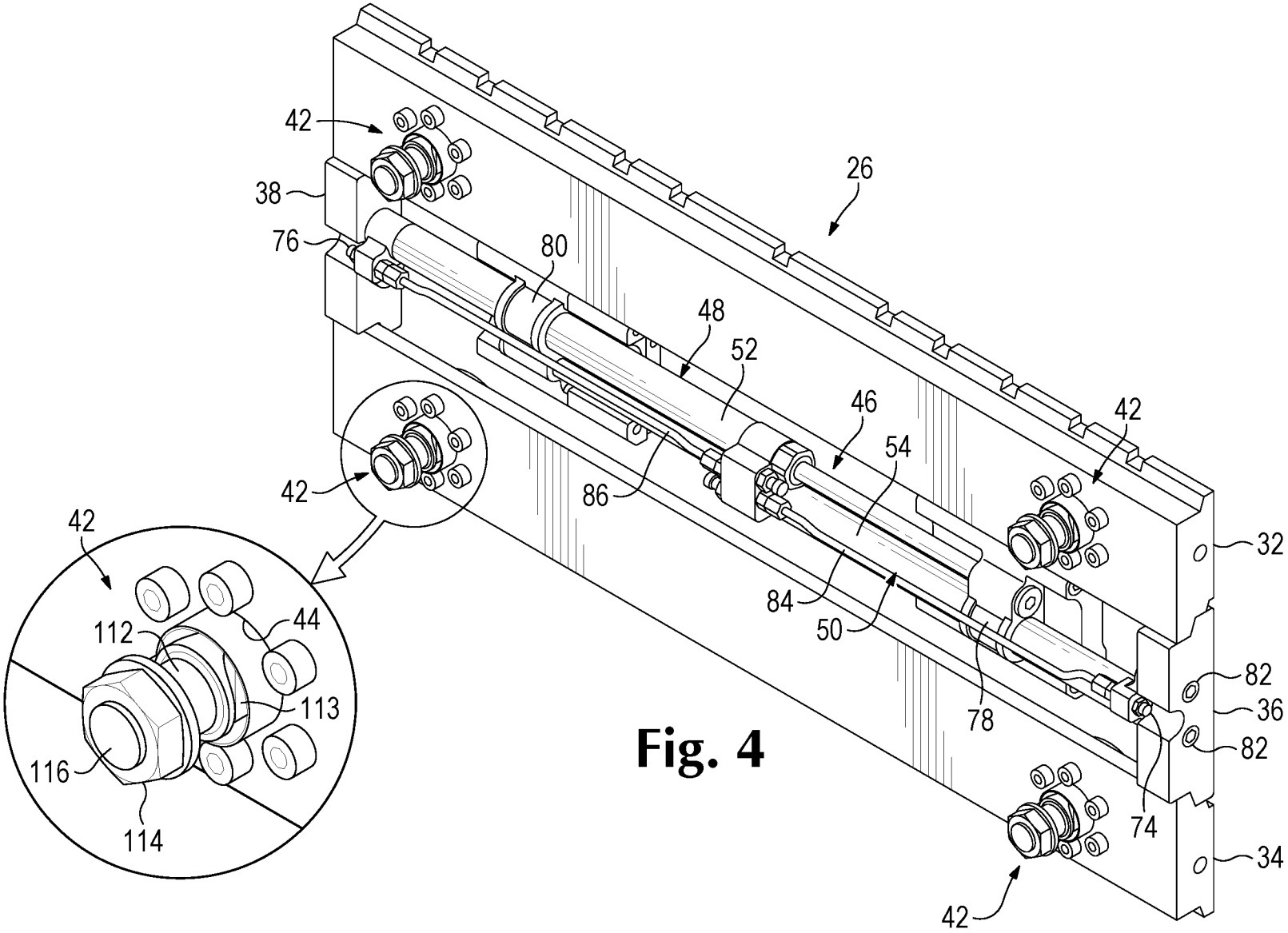
FIG. 4 is a rear perspective view of the faceplate assembly of the integrated lift truck attachment assembly of FIG. 1.

Referring to FIGS. 3-4, faceplate assembly 26 includes an upper transverse faceplate member 32 and a lower transverse faceplate member 34, which are parallel, co-planar, and spaced from each other. End vertical faceplate members 36, 38 are disposed between the transverse faceplate members and connect the transverse faceplate members to define a faceplate central cavity 40 therebetween. The end vertical faceplate members are spaced and parallel to each other and are coplanar with the upper and lower transverse faceplate members. When weighing capability is desired, one or more load cell assemblies 42 are received in one or more faceplate holes 44. The load cell assemblies include one or more load cells 43 that measure the weight of a load supported by on lift forks 24, such as via measuring deflection of the faceplate assembly and/or frame assembly and converting that deflection into a weight measurement. In the example shown in FIGS. 3-4, the faceplate assembly includes four load cell assemblies 42 are shown. The faceplate assembly may, however, include more or less load cell assemblies. The faceplate assembly is designed to lift truck carriage dimensional standards. When the faceplate assembly includes one or more load cell assemblies, the faceplate assembly may also be referred to as an "outer weighing faceplate."

In the example shown in FIGS. 3-4, faceplate assembly 26 includes a fork positioner 46 disposed within faceplate central cavity 40. The fork positioner includes a pair of elongate bidirectional hydraulic piston and cylinder assemblies 48 and 50 each having a respective cylinder 52, 54 with a respective base portion 56, 58 at one end and a respective rod end portion 60, 62 at the other end from which a respective piston rod 64, 66 is extensible. A cylinder connector 68 is configured to interconnect rod end portion 60 of one cylinder rigidly to rod end portion 62 the other cylinder so that the longitudinal axes of the piston rods are parallel to each other.

Figure 5:
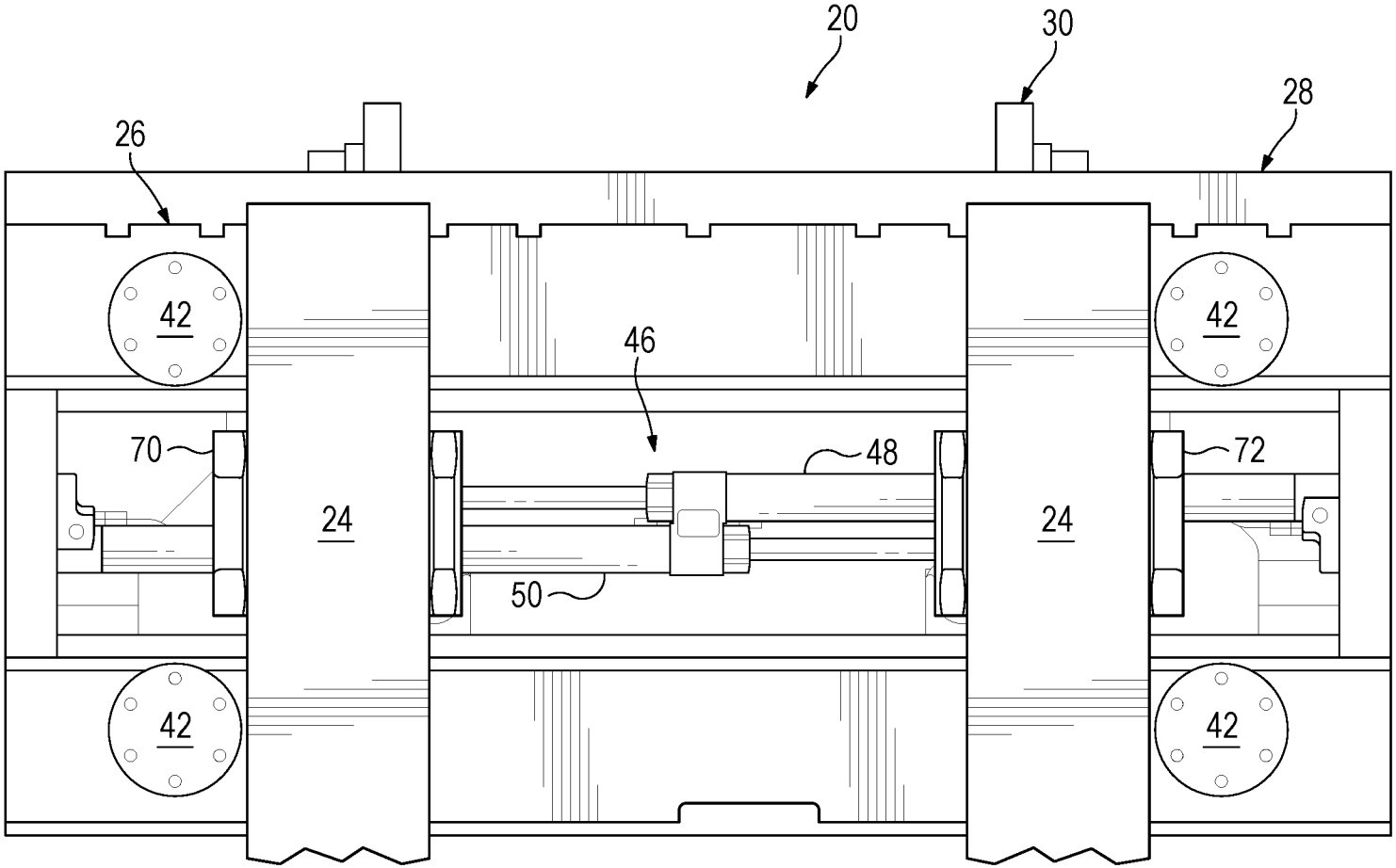
FIG. 5 is a front view of the integrated lift truck attachment assembly of FIG. 1, shown with the lift forks moved apart.
Figure 6:
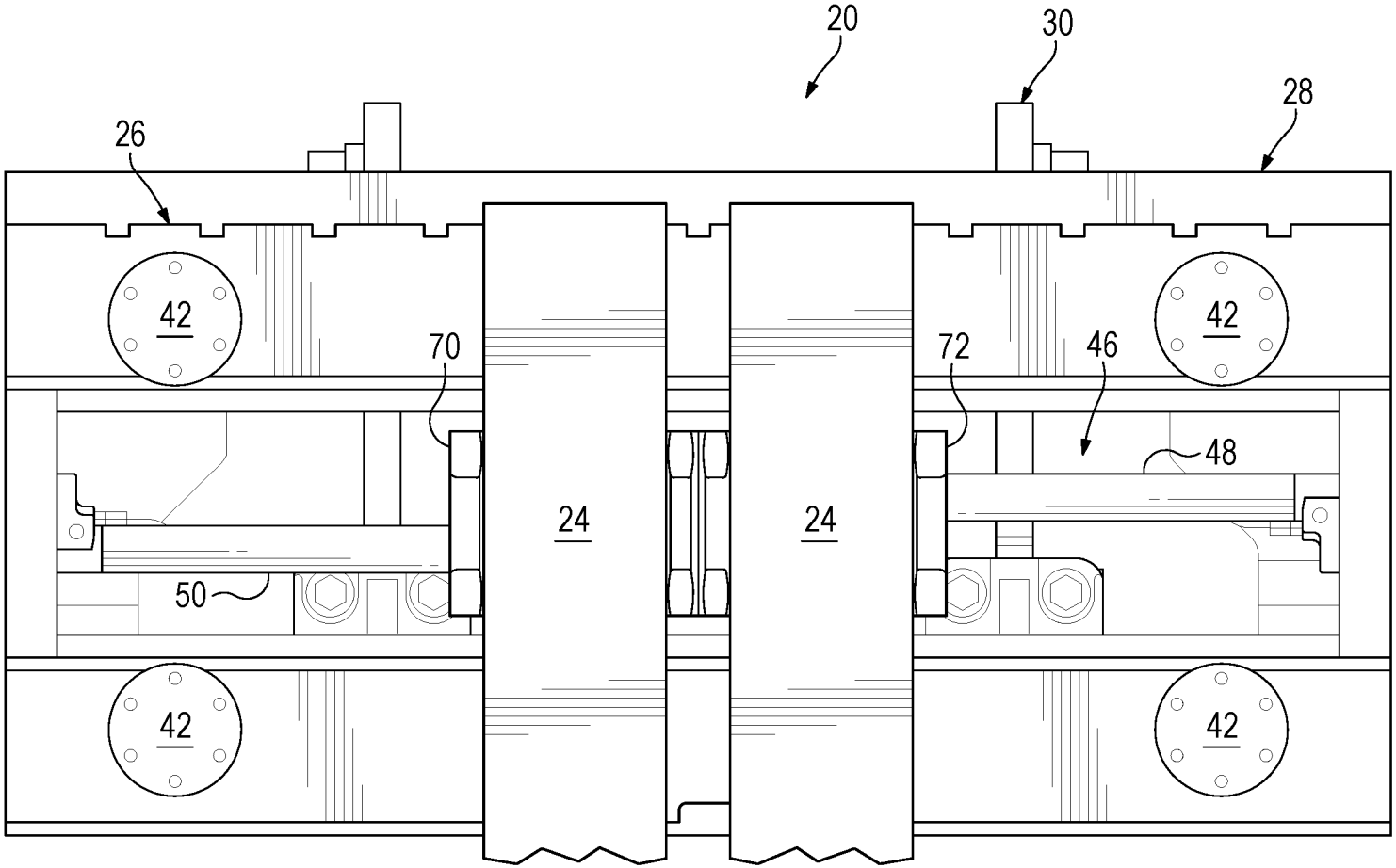
FIG. 6 is a front view of the integrated lift truck attachment assembly of FIG. 1, shown with the lift forks moved together.

A pair of fork-positioning guide members 70, 72 each connects to a respective piston rod 64, 66 via a respective rod connector 74, 76, while also slidably and guidably engaging respective cylinder 52, 54 of the opposite piston and cylinder assembly by a respective slide bushing 78, 80. In the example shown in FIGS. 3-4, piston and cylinder assemblies 48 and 50 are mounted to end faceplate members 36 and 38 via fasteners 82. Cylinder connector 34 includes one or more hydraulic fluid line connectors 84, 86 communicating with the interior of respective cylinders 52, 54. Fork-positioning guide members 70, 72 receive the forks and are moved by piston rods 64, 66 to move those forks toward and away from each other, as shown in FIGS. 5-6. Although the fork-positioning guide members are shown to receive forks, those guide members may receive and move other attachments.

An example of fork positioner 46 is further described in U.S. Pat. No. 7,909,563, the complete disclosure of which is hereby incorporated by reference for all purposes. The nesting of the fork positioner within the faceplate central cavity reduces the width of lift truck attachment assembly 20. Although faceplate assembly 26 is shown to include fork positioner 46, other examples of the faceplate assembly may exclude the fork positioner. In those examples, the forks may be attached to the faceplate assembly by other means, such as via notches on the upper transverse faceplate member. In some examples, faceplate assembly 26 may not include any device(s) or structure(s) within the faceplate central cavity.

Figure 7:
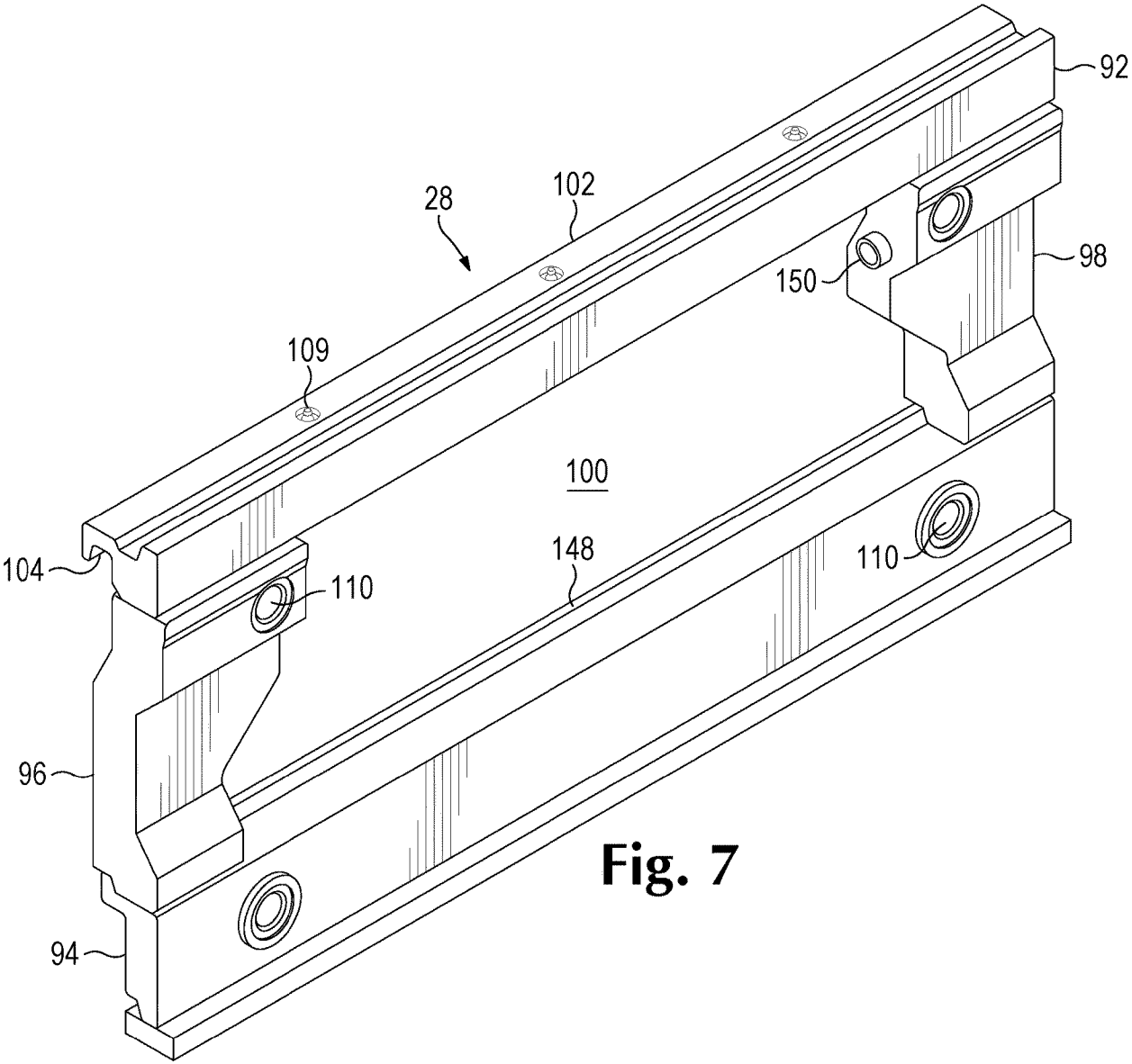
FIG. 7 is a perspective view of a frame assembly of the integrated lift truck attachment assembly of FIG. 1.

Referring to FIG. 7, frame assembly 28 includes an upper transverse frame member 92 and a lower transverse frame member 94, which are parallel, coplanar, and spaced from each other. End vertical frame members 96, 98 are disposed between the transverse frame members and connect the transverse frame members to define a frame central cavity 100 therebetween. The end vertical frame members are spaced and parallel to each other and are coplanar with the upper and lower transverse frame members. Additionally, the end vertical frame members have widths that are greater than the widths of the upper and lower transverse frame members (as best seen in FIG. 2) to provide a mounting point for the loads cell assemblies (when included) and to reduce deflections of the faceplate assembly.

Upper transverse frame member 92 includes a downward hook portion 102 that extends across substantially or the entire length of that frame member and extends toward the carriage assembly when slidably received by the carriage assembly. The downward hook portion includes a groove 104 that receives sliding supports of the upper transverse carriage member of the carriage assembly, as further discussed below. In the example shown in FIG. 7, upper slide bearings 106 are disposed within groove 104. Additionally, lower slide bearings 108 are attached to the rear surface of the lower transverse frame member (i.e., surface facing the lower transverse carriage member of the carriage assembly). The upper and lower slide bearings reduce friction to facilitate sliding movement of the frame and faceplate assemblies relative to the carriage assembly. In the example shown in FIG. 7, the upper transverse frame member includes grease fittings 109 that allow a user to inject grease adjacent to and along the upper slide bearings.

Figure 8:
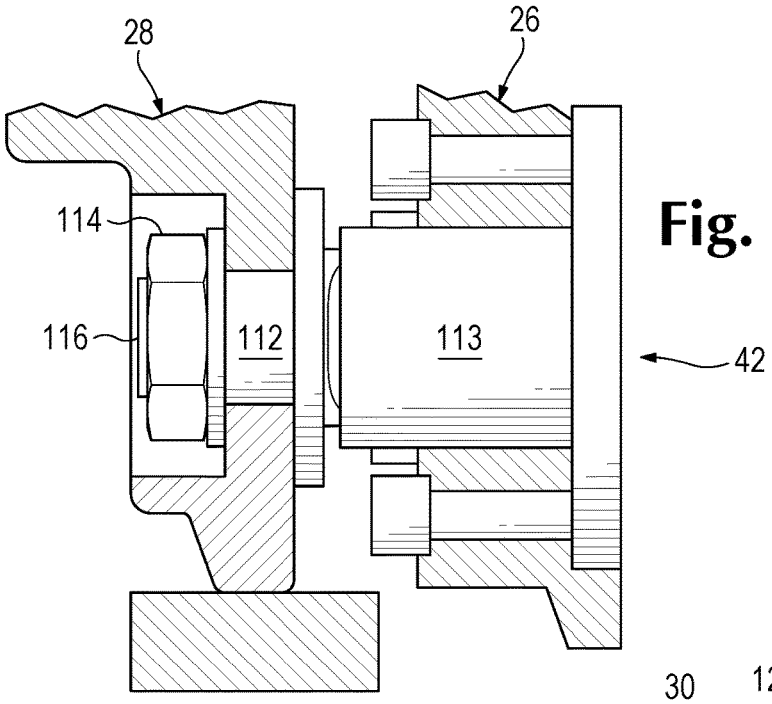
FIG. 8 is a partial sectional view of the integrated lift truck attachment of FIG. 1 along lines 8-8 in FIG. 1 showing a load cell assembly and a fastener to secure the faceplate assembly of FIGS. 3-4 to the frame assembly of FIG. 7.

End vertical frame members 96, 98 and lower transverse frame member 94 include one or more frame holes 110 that correspond with faceplate holes 44 of the faceplate assembly. When attachment assembly 20 includes one or more load cell assemblies 42, protruding portions 112 on housing 113 of those load cell assemblies may be received in the faceplate and frame hole(s) and secured or fixedly attached to the frame assembly and the faceplate assembly via fasteners 114, which also secures the faceplate assembly to the frame assembly. The protruding portions of the load cell assemblies include threaded portions 116 that receive fasteners 114 in the form of nuts (see FIGS. 2, 4, and 8). In some examples, the faceplate assembly is secured to the frame assembly via only the load cell assemblies and the fasteners. In other words, the rest of the faceplate assembly may be supported by the load cell assemblies. The frame assembly thus allows lateral movement relative to the carriage assembly and serves as anchor points for the weighing load sensing components.

Figure 9:
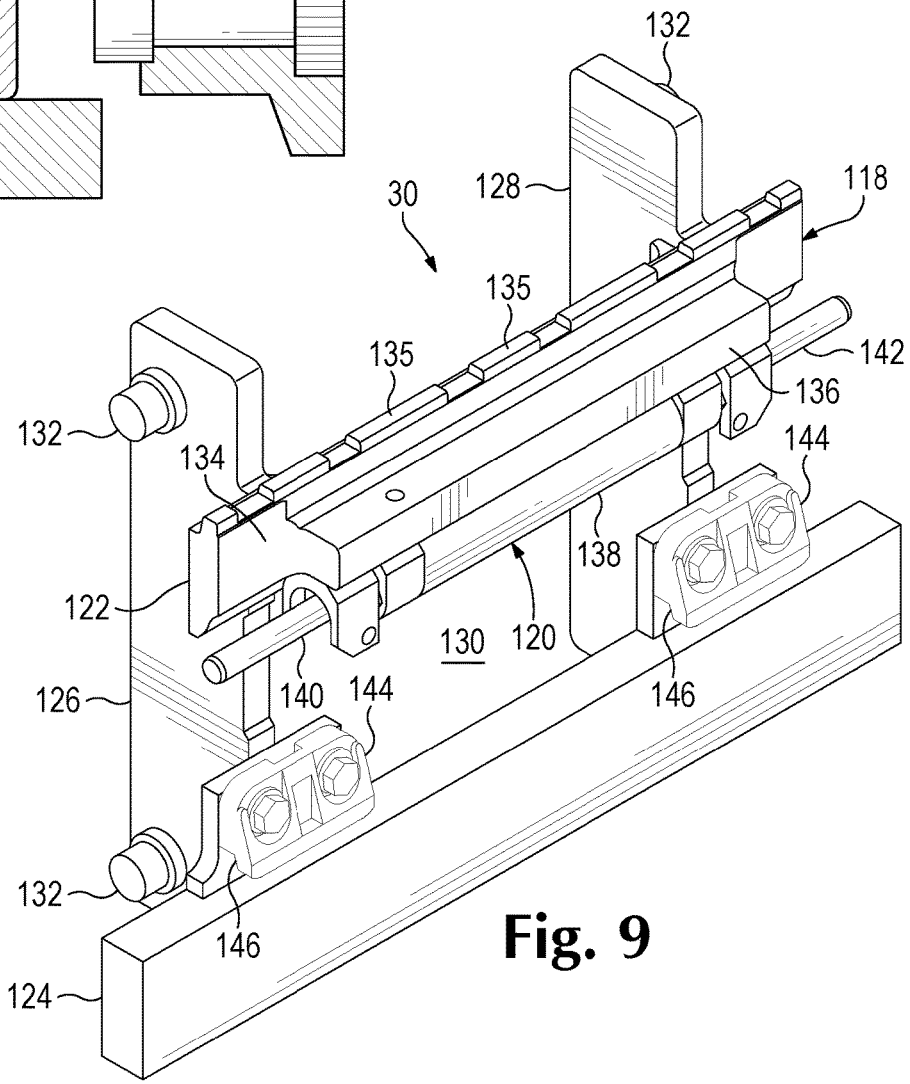
FIG. 9 is a perspective view of a carriage assembly of the integrated lift truck attachment assembly of FIG. 1.

Referring to FIG. 9, carriage assembly 30 includes a carriage 118 and a lateral or linear actuator 120 attached to the carriage. The carriage includes an upper transverse carriage member 122 and a lower transverse carriage member 124, which are spaced and parallel to each other. End vertical carriage members 126, 128 are attached to rear surfaces of the transverse carriage members and connect the transverse carriage members to define a carriage central cavity 130 therebetween. The end vertical carriage members are spaced and parallel to each other. Additionally, the end vertical carriage members include posts 132 that are received in mast channels of a lift truck (as shown in FIG. 1). Upper transverse carriage member 122 includes a base portion 134 that is coplanar with the lower transverse carriage member, raised portions or upper lateral slide supports 135 that are received in groove 104 of the frame assembly, and an extended portion or ledge 136 that extends perpendicularly from the base portion toward the frame assembly. The upper transverse carriage member carries both fore/aft load and the vertical load thus allowing the central cavities in the various assemblies of lift truck attachment assembly 20 without any central support structure(s) to support the above load(s). Lower transverse carriage member 124 may sometimes be referred to as a "lower lateral slide support."

In the example shown in FIG. 9, linear actuator 120 is attached to an underside of ledge 136. The linear actuator is configured to move the frame assembly and the faceplate assembly sideways relative to the carriage assembly. The linear actuator includes a body or cylinder 138 and piston rods 140, 142 slidably received in the cylinder. The piston rods are longitudinally opposed or move along a common longitudinal axis. Carriage assembly 130 further includes brackets 144 attached to lower transverse carriage member 124. The brackets include a slot 146 to receive a lip 148 of the frame assembly. Carriage assembly 130 may sometimes be referred to as a "stationary frame."

Figure 10:
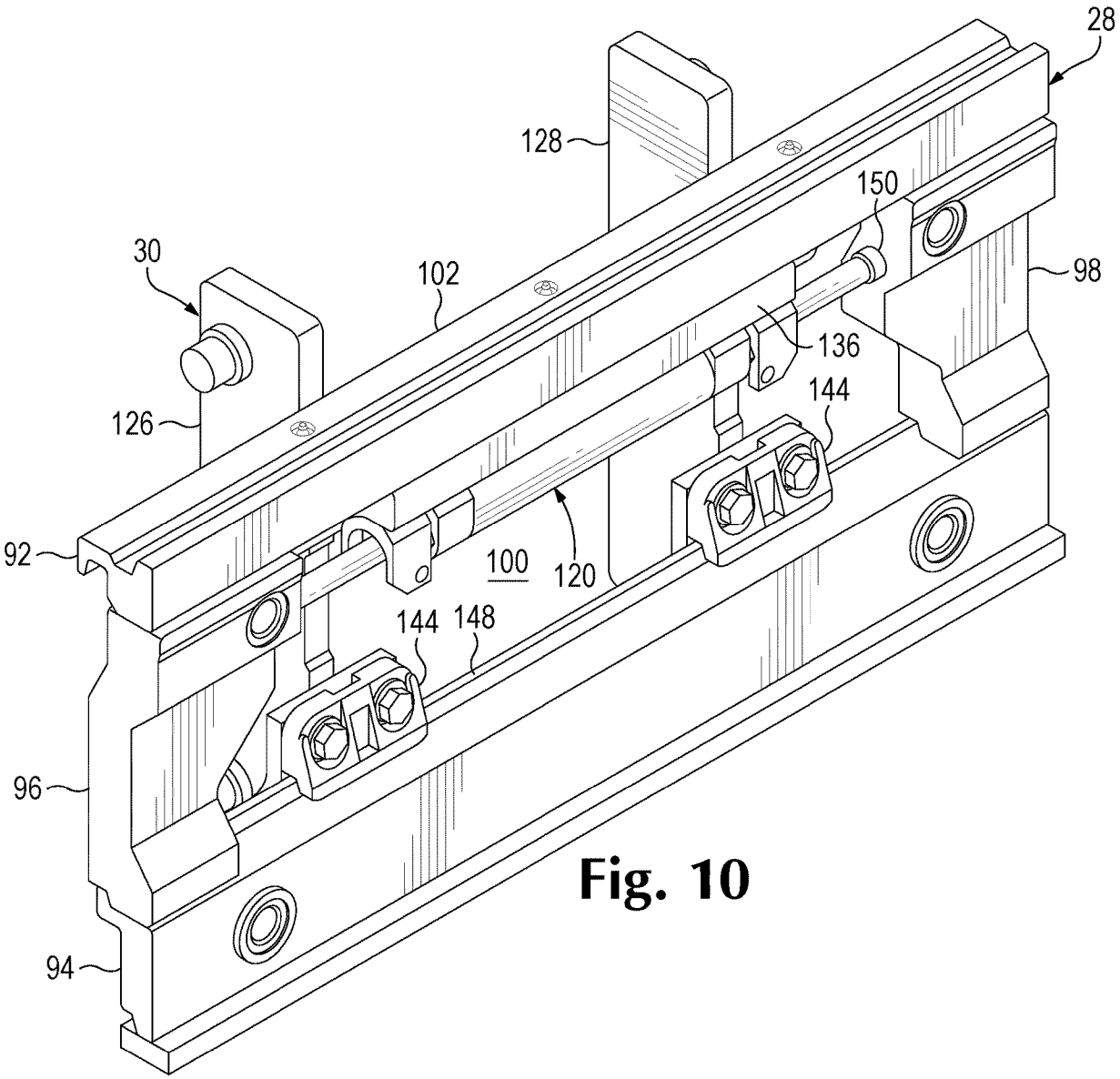
FIG. 10 is a perspective view of the integrated lift truck attachment assembly of FIG. 1, shown without the faceplate assembly.
Figure 11:
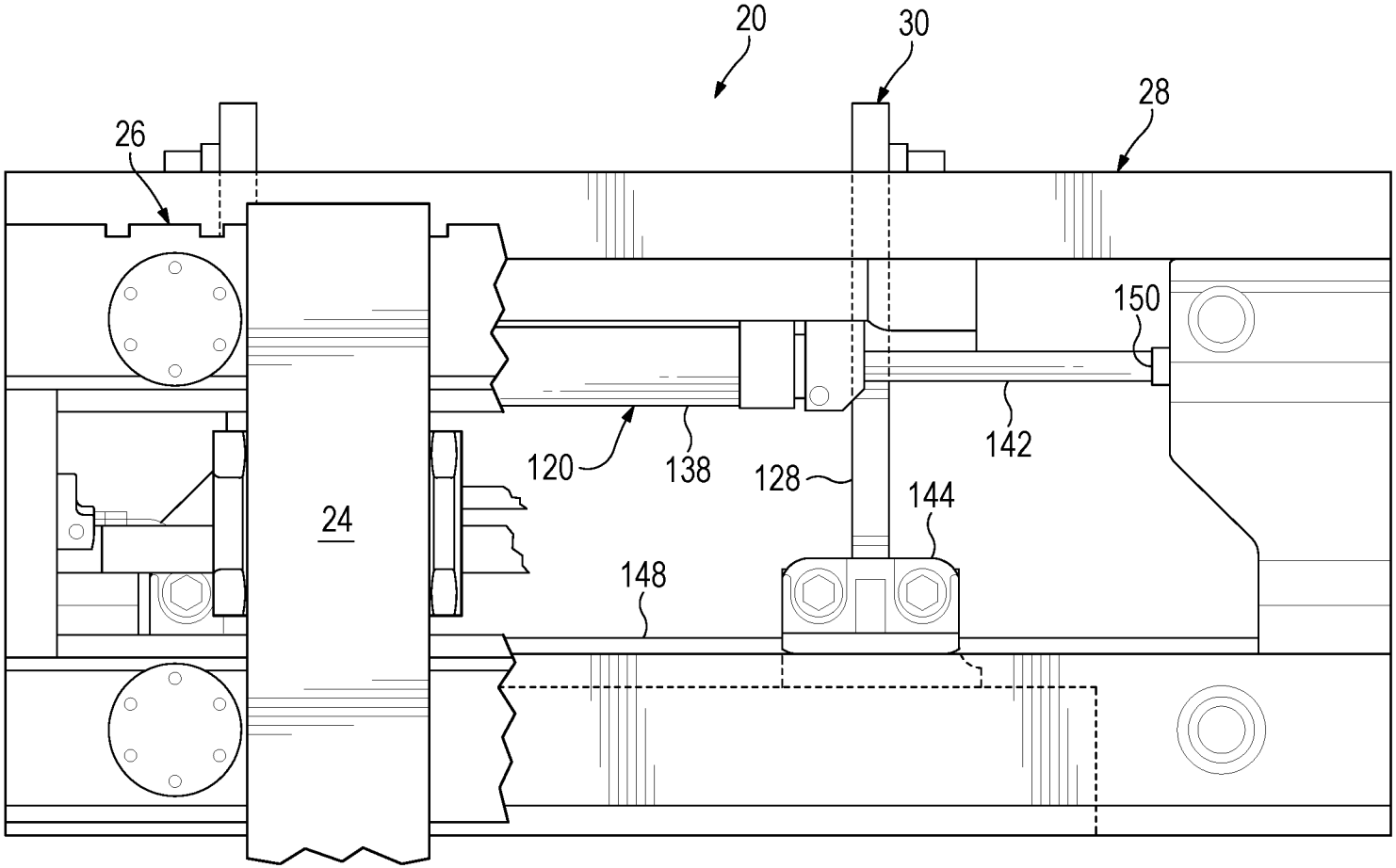
FIG. 11 is a front view of the integrated lift truck attachment assembly of FIG. 1, shown with the frame assembly and faceplate assembly moved to one side and without some portions of the faceplate assembly to show movement of piston ends of a linear actuator of the carriage assembly.
Figure 12:
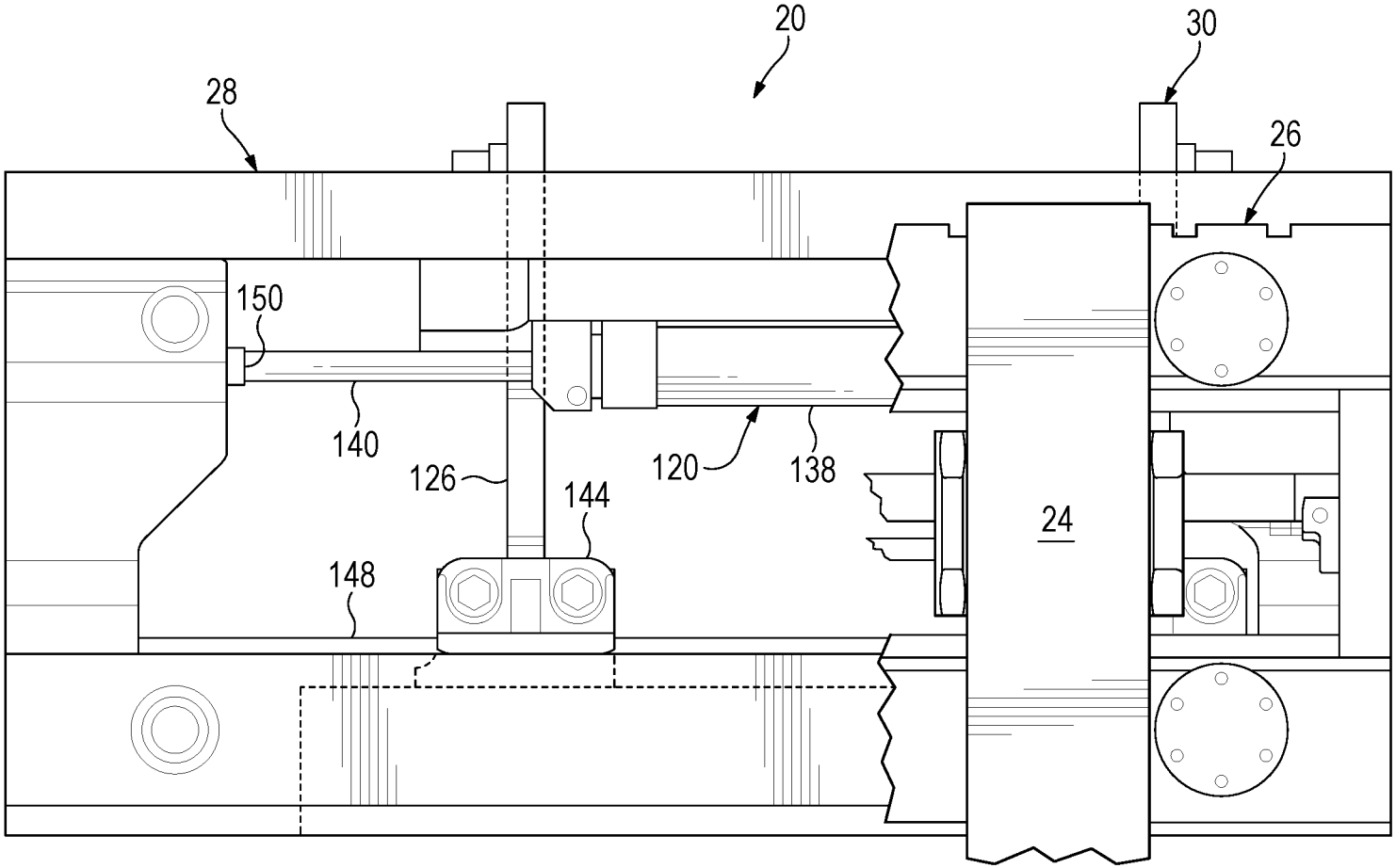
FIG. 12 is a front view of the integrated lift truck attachment assembly of FIG. 1, shown with the frame assembly and faceplate assembly moved to the opposite side of FIG. 11 and without some portions of the faceplate assembly to show movement of piston ends of a linear actuator of the carriage assembly.

Referring to FIG. 10, the ledge of the upper transverse carriage member and/or the linear actuator are sized such that the linear actuator is received within frame central cavity 100 of the frame assembly. The nesting of the linear actuator within the plane of the frame assembly substantially reduces the width of lift truck attachment assembly 20. The ends of the piston rods of the linear actuator are received in reaction blocks or rod connectors 150 that are fixedly attached to end vertical faceplate members 96, 98 of the frame assembly. In other words, the piston rods of the linear actuator contact the end vertical faceplate members. Extension and retraction of the piston rods move the frame assembly and faceplate assembly laterally or sideways (or parallel to the common longitudinal axis of the piston rods) relative to the carriage assembly, as shown in FIGS. 11-12. Movement of the frame and faceplate assemblies by the linear actuator are within the planes of the frame and faceplate assemblies (i.e., faceplate FP and frame FR planes shown in FIG. 2).

Although a particular example of carriage assembly is shown in FIG. 10, other carriage assemblies may be used for integrated lift truck attachment assembly. For example, a standard carriage without a linear actuator may be used instead of the carriage assembly shown in FIG. 10. The frame and faceplate assemblies may be fixedly attached to the standard carriage to provide weighing capability and/or fork positioning capability (when the faceplate assembly includes a fork positioner).

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A lift truck attachment assembly, comprising:

a carriage assembly having a carriage and a linear actuator attached to the carriage, wherein the carriage is mountable to a lift truck, and wherein the linear actuator includes a body and longitudinally opposed piston rods slidably received in the body, each of the piston rods having an end;

a frame assembly slidably connected to the carriage, the frame assembly having upper and lower transverse frame members and end vertical frame members connecting the upper and lower transverse frame members in a spaced relationship to define a frame central cavity therebetween, wherein the linear actuator is disposed within the frame central cavity such that the ends of the piston rods contact the end vertical frame members allowing the linear actuator to slide the frame assembly laterally relative to the carriage assembly; and a faceplate assembly fixedly attached to the frame assembly, the faceplate assembly being configured to receive one or more forks and including:

one or more load cells configured to measure the weight of a load when supported by the one or more forks, upper and lower transverse faceplate members and end vertical faceplate members connecting the upper and lower transverse faceplate members in a spaced relationship to define a faceplate central cavity therebetween, wherein at least one of the upper or lower transverse faceplate members includes least one faceplate hole and the frame assembly includes at least one frame hole that corresponds with the at least one faceplate hole, wherein the at least one load cell of the one or more load cells is contained within at least one housing, and wherein the at least one housing is received in the at least one faceplate hole and the at least one frame hole, and a fork positioner disposed within the faceplate central cavity, the fork positioner being configured to selectively move a pair of forks toward or away from each other.

2. The assembly of claim 1, wherein the frame assembly includes at least one fastener to secure the at least one housing to the at least one faceplate hole and the at least one frame hole and to secure the face plate assembly to the frame assembly.

3. The assembly of claim 1, wherein a substantial portion of the carriage is in a carriage plane, a substantial portion of the frame assembly is in a frame plane that is parallel to the carriage plane, and the faceplate assembly is in a faceplate plane that is parallel to the frame plane.

4. The assembly of claim 1, wherein the carriage includes an upwardly protruding portion and the upper transverse frame member includes a downward hook portion having a groove, wherein the protruding portion is received in the groove to allow the frame assembly to slide laterally relative to the carriage assembly.

5. The assembly of claim 1, wherein a substantial portion of the carriage is in a first plane and a substantial portion of the frame assembly is in a second plane that is parallel to the first plane.

6. A lift truck attachment assembly, comprising:

a carriage assembly having a carriage and a linear actuator attached to the carriage, wherein the carriage is mountable to a lift truck, and wherein the linear actuator includes a body and longitudinally opposed piston rods slidably received in the body, each of the piston rods having an end;

a frame assembly slidably connected to the carriage, the frame assembly having upper and lower transverse frame members and end vertical frame members connecting the upper and lower transverse frame members in a spaced relationship to define a frame central cavity therebetween, wherein the linear actuator is disposed within the frame central cavity such that the ends of the piston rods contact the end vertical frame members allowing the linear actuator to slide the frame assembly laterally relative to the carriage assembly, and wherein the carriage includes an upwardly protruding portion and the upper transverse frame member includes a downward hook portion having a groove, wherein the protruding portion is received in the groove to allow the frame assembly to slide laterally relative to the carriage assembly; and a faceplate assembly fixedly attached to the frame assembly, the faceplate assembly is configured to receive one or more forks, wherein the faceplate assembly includes one or more load cells configured to measure the weight of a load when supported by the one or more forks, wherein the faceplate assembly includes upper and lower transverse faceplate members and end vertical faceplate members connecting the upper and lower transverse faceplate members in a spaced relationship to define a faceplate central cavity therebetween, wherein at least one of the upper or lower transverse faceplate members includes least one faceplate hole and the frame assembly includes at least one frame hole that corresponds with the at least one faceplate hole, wherein the at least one load cell of the one or more load cells is contained within at least one housing, and wherein the at least one housing is received in the at least one faceplate hole and the at least one frame hole, and wherein the faceplate assembly further includes a fork positioner disposed within faceplate central cavity, the fork positioner configured to selectively move a pair of forks toward or away from each other.

* * * * *